US006491565B1

(12) United States Patent
McCullough

(10) Patent No.: US 6,491,565 B1
(45) Date of Patent: Dec. 10, 2002

(54) PERSONALIZED DOLL SYSTEM

(76) Inventor: Marie D. McCullough, 20 Edgewood Rd., Rumson, NJ (US) 07760

( * ) Notice: Subject to any disclaimer, the term of this patent is extended or adjusted under 35 U.S.C. 154(b) by 0 days.

(21) Appl. No.: 08/905,462

(22) Filed: Aug. 4, 1997

Related U.S. Application Data

(63) Continuation of application No. 08/674,120, filed on Jul. 1, 1996.

(51) Int. Cl.[7] ..... A63H 3/36
(52) U.S. Cl. ..... 446/391; 446/369; 446/268
(58) Field of Search ..... 446/369, 391

(56) References Cited

U.S. PATENT DOCUMENTS

| | | | | | |
|---|---|---|---|---|---|
| 2,170,971 | A | * | 8/1939 | Lodewick et al. | 446/391 X |
| 4,659,319 | A | * | 4/1987 | Blair | 446/391 X |
| 4,795,397 | A | * | 1/1989 | Stevens | 446/369 X |
| 5,403,224 | A | * | 4/1995 | Gintling | 446/391 X |
| 5,515,592 | A | * | 5/1996 | Mills | 446/391 X |
| 6,071,171 | A | * | 6/2000 | George et al. | 446/391 |
| 6,099,378 | A | * | 6/2000 | George et al. | 446/391 |

OTHER PUBLICATIONS

Thousand Oaks News Chronicle—"Helping Children Make It", news article, pp. A1, A8, Sep. 3, 1994.*
1994 Version of My Twinn Order Form.*
My Twinn product postcard, bulk mailed Sep. 1993.*
"My Twinn—About My Twinn Dolls", brochure acquired Feb. 11, 1999 stating a 5–year anniversary of the My Twinn product, http://www.mytwinn.com.*
"American Girl of Today"— product catalog for customized dolls, Holiday 1995 catalog.*
My Twinn product catalog and order form, received Oct. 10, 1995.*

* cited by examiner

*Primary Examiner*—Derris H. Banks
*Assistant Examiner*—Kurt Fernstrom

(57) ABSTRACT

A personalized doll system includes a picture of the face and upper torso of an individual; and a doll with a head, a neck, a torso, two arms including two hands and two legs including two feet, the head including two eyes, a nose, a mouth and hair, the torso including a dress and an apron, the legs including two shoes including two shoes, each shoe including a base portion and an ankle strap, in an operative orientation a user taking a Polaroid photograph, and fabricating a doll with the characteristics of the individual.

1 Claim, 3 Drawing Sheets

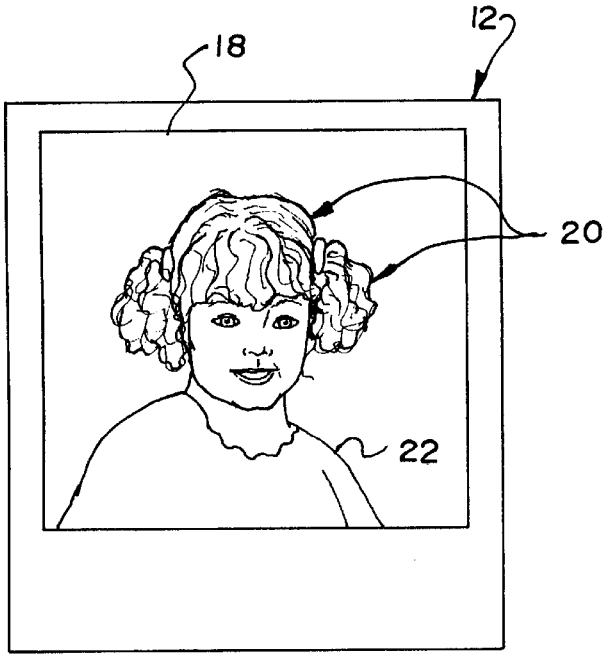
Fig. 1
Fig. 2
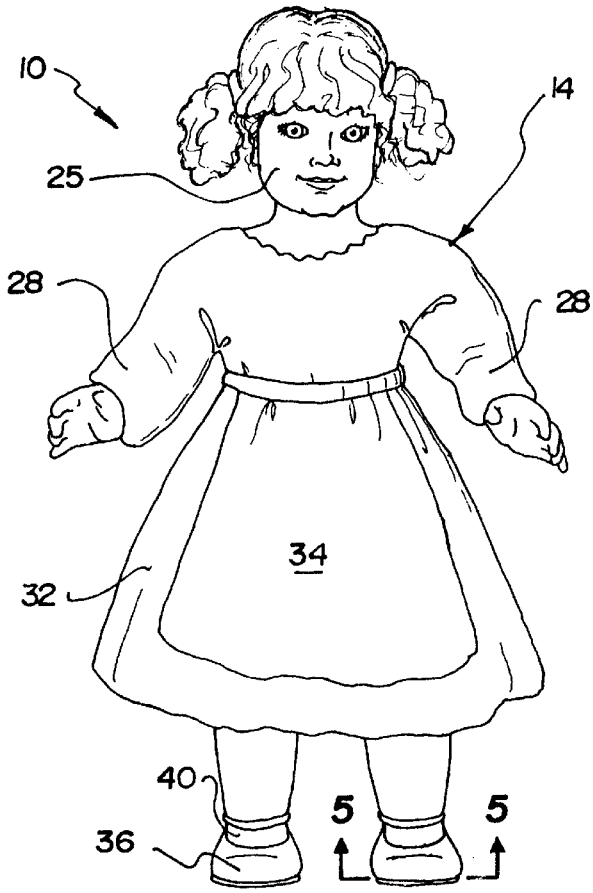

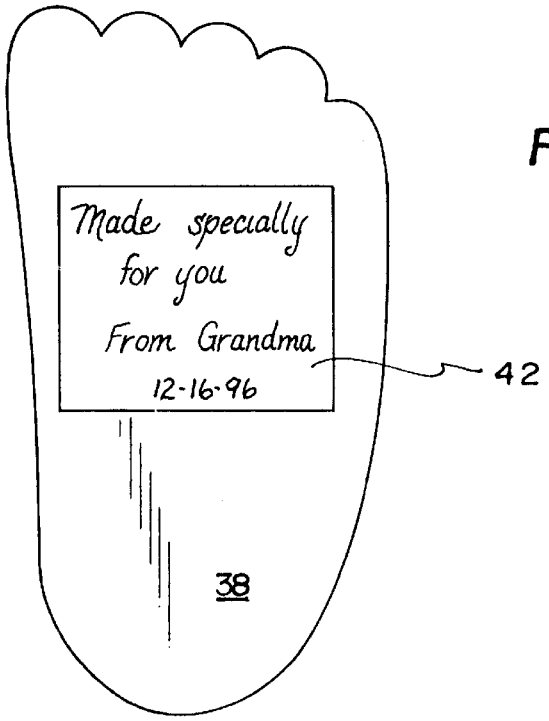
Fig. 5
Fig. 6
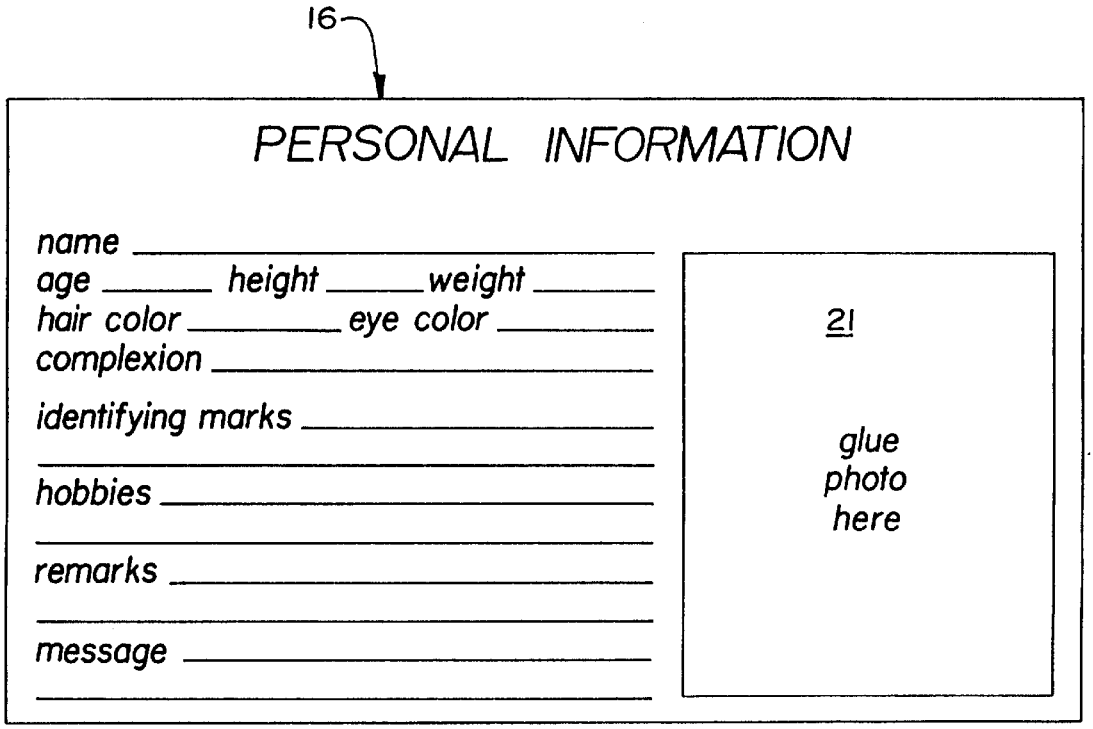

PERSONALIZED DOLL SYSTEM

This application is continuation of application Ser. No. 08/674,120 filed Jul. 1, 1996, now abandoned.

BACKGROUND OF THE INVENTION

1. Field of the Invention

The present invention relates to a personalized doll system and more particularly pertains to incorporating an individual's photograph and attire preferences into a doll figure.

2. Description of the Prior Art

The use of entertaining users is known in the prior art. More specifically, entertaining users heretofore devised and utilized for the purpose of dolls are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,314,370 to Flint discloses a process for producing a doll.

U.S. Pat. No. 4,659,319 to Blair discloses an image in three dimensions with picture covering and forming system.

U.S. Pat. No. 5,403,224 to Gintling discloses a photograph face doll with removable face pocket.

U.S. Pat. No. 5,141,466 to Catizone discloses a doll construction.

U.S. Pat. No. 5,382,187 to Wilson discloses a doll having a photograph for a face.

U.S. Pat. No. 5,004,442 to Lemelson et al. disclosing educational toys.

In this respect, the personalized doll system according to the present invention substantially departs from the conventional concepts and designs of the prior art, and in doing so provides an apparatus primarily developed for the purpose of incorporating an individual's photograph and attire preferences into a doll figure.

Therefore, it can be appreciated that there exists a continuing need for a new and improved personalized doll system which can be used for incorporating an individual's photograph and attire preferences into a doll figure. In this regard, the present invention substantially fulfills this need.

SUMMARY OF THE INVENTION

In view of the foregoing disadvantages inherent in the known types of entertaining users now present in the prior art, the present invention provides an improved personalized doll system. As such, the general purpose of the present invention, which will be described subsequently in greater detail, is to provide a new and improved personalized doll system and method which has all the advantages of the prior art and none of the disadvantages.

To attain this, the present invention essentially comprises a new and improved personalized doll system for use in association with a Polaroid camera and film, the apparatus comprising, in combination: a Polaroid picture of the face and upper torso of an individual; a personal information card formed in a generally rectangular configuration and including indicia marked thereon, the indicia including the words PERSONAL INFORMATION, name, age, height, weight, hair color, eye color, complexion, identifying marks, hobbies, remarks, message, and glue photo here; and a doll formed in a generally elongated configuration with a head, a neck, a torso, two arms including two hands and two legs including two feet, the head including two eyes, a nose, a mouth and hair being styled into pigtails, the torso including a dress and an apron, the feet having shoes positioned therearound, each shoe including a base portion and an ankle strap, the base portion having a label with indicia including the words Made specially for you, the label further including the applicable date and a signature, in an operative orientation a user taking the Polaroid picture, describing an individual on the personal information card and fabricating a doll with the characteristics of the individual.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved personalized doll system which has all of the advantages of the prior art entertaining users and none of the disadvantages.

It is another object of the present invention to provide a new and improved personalized doll system which may be easily and efficiently manufactured and marketed.

It is further object of the present invention to provide a new and improved personalized doll system which is of durable and reliable constructions.

An even further object of the present invention is to provide a new and improved personalized doll system which is susceptible of a low cost of manufacture with regard to both materials and labor, and which accordingly is then susceptible of low prices of sale to the consuming public, thereby making such personalized doll system economically available to the buying public.

Still yet another object of the present invention is to provide a new and improved personalized doll system which provides in the apparatuses and methods of the prior art some of the advantages thereof, while simultaneously overcoming some of the disadvantages normally associated therewith.

Still another object of the present invention is incorporating an individual's photograph and attire preferences into a doll figure.

Lastly, it is an object of the present invention to provide a new and improved personalized doll system comprises a picture of the face and upper torso of an individual; and a doll with a head, a neck, a torso, two arms including two hands and two legs including two feet, the head including two eyes, a nose, a mouth and hair, the torso including a dress and an apron, the legs including two shoes including two shoes, each shoe including a base portion and an ankle strap, in an operative orientation a user taking the Polaroid picture, and fabricating a doll with the characteristics of the individual.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the Polaroid picture of the personalized doll system constructed in accordance with the principles of the present invention.

FIG. 2 is a front perspective view of the personalized doll.

FIG. 5 is a perspective view of the foot of the doll taken along line 5—5 of FIG. 2.

FIG. 6 is a perspective view of the Personal Information card of the apparatus.

The same reference numerals refer to the same parts through the various Figures.

DESCRIPTION OF THE PREFERRED EMBODIMENT

Figure 3:
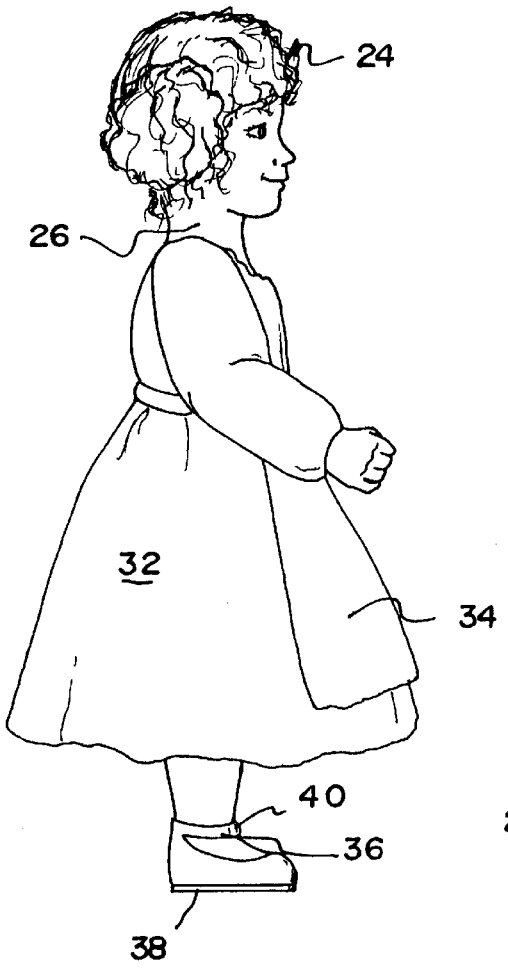
FIG. 3 is a side perspective view of the doll.

With reference now to the drawings, and in particular to FIG. 1 thereof, the preferred embodiment of the new and improved personalized doll system embodying the principles and concepts of the present invention and generally designated by the reference numeral 10 will be described.

The present invention, the personalized doll system 10 is comprised of a plurality of components. Such components in their broadest context include a Polaroid picture 12, a doll 14, and a Personal Information card 16. Such components are individually configured and correlated with respect to each other so as to attain the desired objective.

More specifically, a generally rectangular Polaroid picture 12 of the head 20 and upper torso 22 of an individual is included with the apparatus. The picture includes a border 18 around its periphery. In the preferred embodiment, the apparatus is adapted for use in association with a Polaroid camera and film. In an alternative embodiment of the apparatus a conventional photograph can be used. Note FIG. 1.

A personal information card 16 is formed in a generally rectangular configuration and includes indicia marked on it. The indicia includes the words PERSONAL INFORMATION. It also includes areas for name, age, height, weight, hair color, eye color, complexion, identifying marks, hobbies of the individual and an area for remarks, a message. Additionally, there is a rectangle and a location to "glue photo here" 21. This allows a user to precisely describe the characteristics of the individual. Note FIG. 6.

Figure 4:
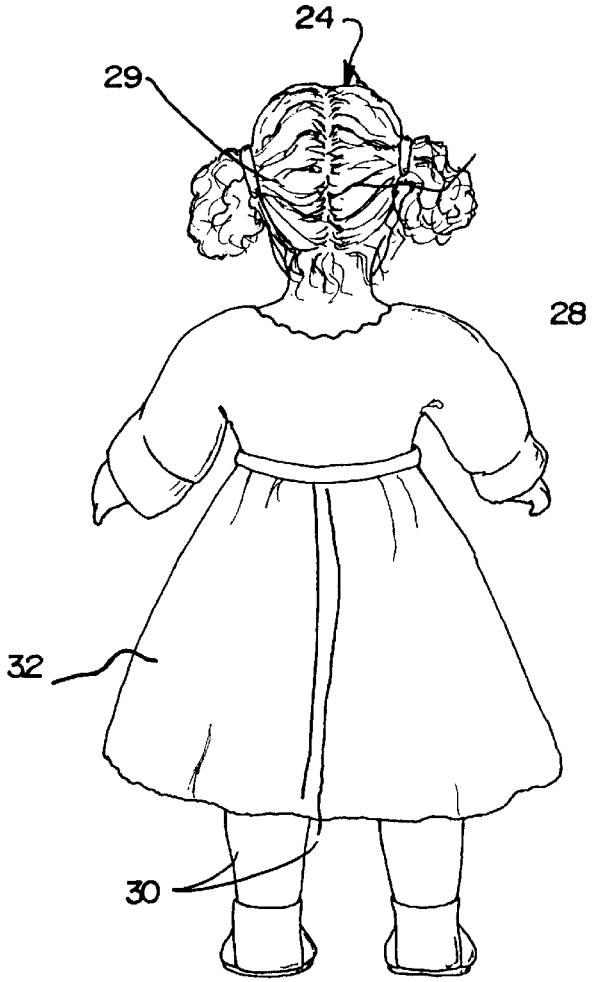
FIG. 4 is a back perspective view of the doll.

A doll 14 is formed in a generally elongated configuration with a head 24, a neck 26 and a torso. The doll has two arms 28 including two hands and two legs 30 including two feet. The head includes a face 25 with two eyes, a nose and a mouth and hair 29 which is styled into pigtails. In alternative embodiments of the apparatus the hair can be styled into a ponytail or a headband. Additionally, the eyes and hair can be fabricated in various colors. Note FIGS. 2–4.

The torso of the doll includes a dress 32 and an apron 34. The dress and apron can be fabricated in the favorite colors of the individual. The feet have shoes 36 positioned around them. Each shoe 36 includes a base portion 38 and an ankle strap 40. In alternative embodiments of the apparatus the torso includes pants and a top and the feet include sneakers. The base portion has a label 42 with indicia including the words Made specially for you. The label 42 further includes the applicable date and a signature. This allows the user to commemorate the doll to the individual. Note FIGS. 2–4.

In an operative orientation a user takes the Polaroid picture 12, describes an individual on the personal information card 16 and fabricates a doll 14 with the characteristics of the individual. Note FIGS. 1–6.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of making a personalized doll and a separate personal information card, the method including the steps of:

providing a camera for taking a picture of the face and upper torso of an individual;

providing a separate personal information card for the individual formed in a generally rectangular configuration and including indicia marked thereon, the indicia including the words PERSONAL INFORMATION, name, age, height, weight, hair color, eye color, complexion, identifying marks, hobbies, remarks, message, and a rectangle which includes the indicia "glue photo here";

providing a doll separate from the identification card and formed in a generally elongated configuration with a head, a neck, a torso, two arms including two hands and two legs including two feet, the head including two eyes, a nose, a mouth and hair, the feet having shoes positioned therearound, each shoe including a base portion, the base portion having a label with indicia including the words "Made specially for you", the label further including an applicable date and a signature;

taking the picture of the individual with the camera to generate first variable data corresponding to first characteristics of the individual;

attaching the picture to the information card;

describing an individual on the personal information card to generate second variable data corresponding to second characteristics of the individual; and fabricating the totally unique doll with the characteristics of the individual based upon the first variable data and second variable data with the associated and totally unique personal information card separate from the doll with the picture attached thereto.

* * * * *